United States Patent [19]

Diamond et al.

[11] Patent Number: 4,620,479

[45] Date of Patent: Nov. 4, 1986

[54] AIRCRAFT TRASH COMPACTOR AND BOX THEREFOR

[75] Inventors: Fredric L. Diamond, Big Bear City; Kenneth E. Andrews, Irvine, both of Calif.

[73] Assignee: A.K.G.S. Partnership, Las Vegas, Nev.

[21] Appl. No.: 635,141

[22] Filed: Jul. 27, 1984

[51] Int. Cl.[4] ..... B30B 15/30

[52] U.S. Cl. ..... 100/215; 100/99; 100/229 A; 100/255; 53/527; 229/41 R

[58] Field of Search ..... 100/229 R, 229 A, 255, 100/99, 100, 215; 53/527; 141/73, 80

[56] References Cited

U.S. PATENT DOCUMENTS

| | | | |
|---|---|---|---|
| 3,514,969 | 6/1970 | Harza | 100/229 A X |
| 3,734,006 | 5/1973 | Hennells | 100/229 A X |
| 3,748,820 | 7/1973 | Fox | 100/229 A X |
| 3,861,117 | 1/1975 | DeFilippi | 53/527 |
| 3,863,561 | 2/1975 | Karls | 100/229 A X |
| 3,903,790 | 9/1975 | Gladwin | 100/229 A X |
| 4,444,099 | 4/1984 | Paleschuck | 100/229 A X |

*Primary Examiner*—Billy J. Wilhite

*Attorney, Agent, or Firm*—Fulwider, Patton, Rieber, Lee & Utecht

[57] ABSTRACT

A trash compactor and collapsible box for use therewith to handle waste material generated during flight of passenger-carrying aircraft. The trash compactor includes a housing formed with front and rear box chambers to receive first and second collapsible trash-receiving boxes. A front door is provided for the housing having a trash-receiving chute in its upper portion. The first box is initially disposed in the front box chamber. When it is filled, the front door is opened and the first box is pushed to the rear box chamber. The second box is then positioned within the front box chamber to receive trash, and the front door is shut. The collapsible boxes have a front wall disposed at the same elevation as the lower edge of the chute, while the tops of the side and rear walls are at a higher elevation than the top of the front wall to permit the boxes to receive a maximum amount of trash for their size. The bottom portion of the wall is of liquid-tight construction.

5 Claims, 15 Drawing Figures

FIG. 8
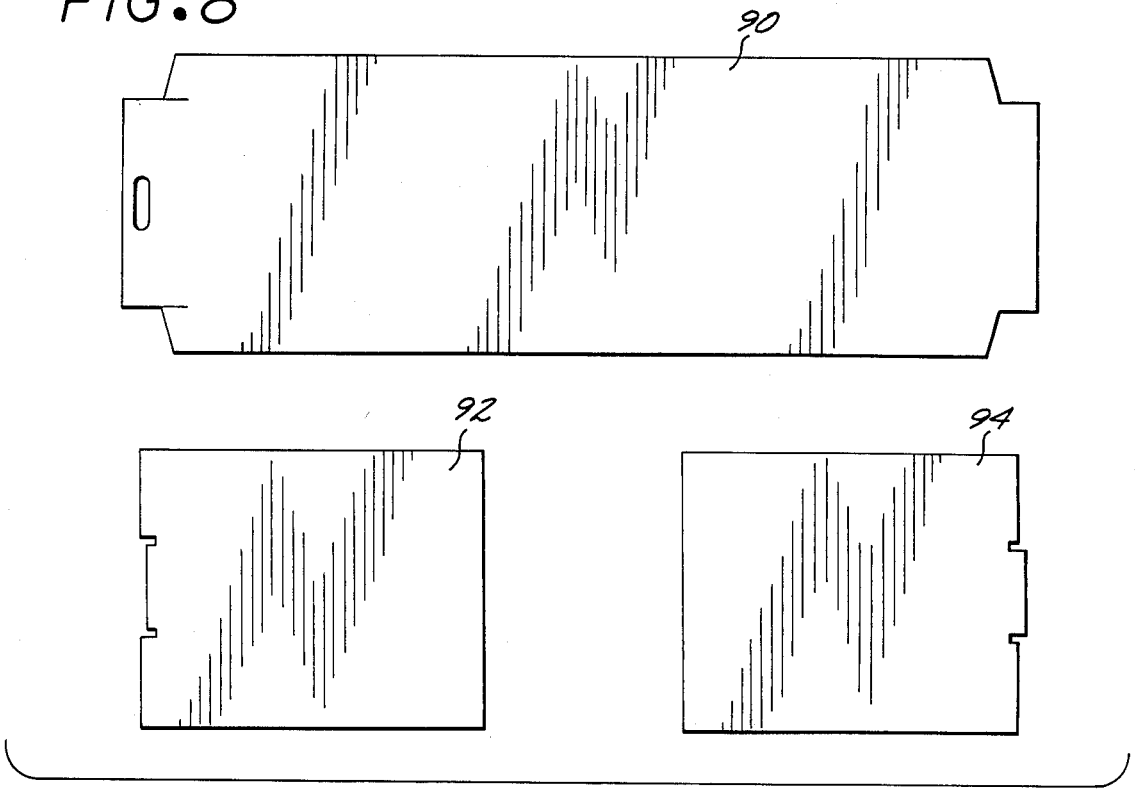
FIG. 9
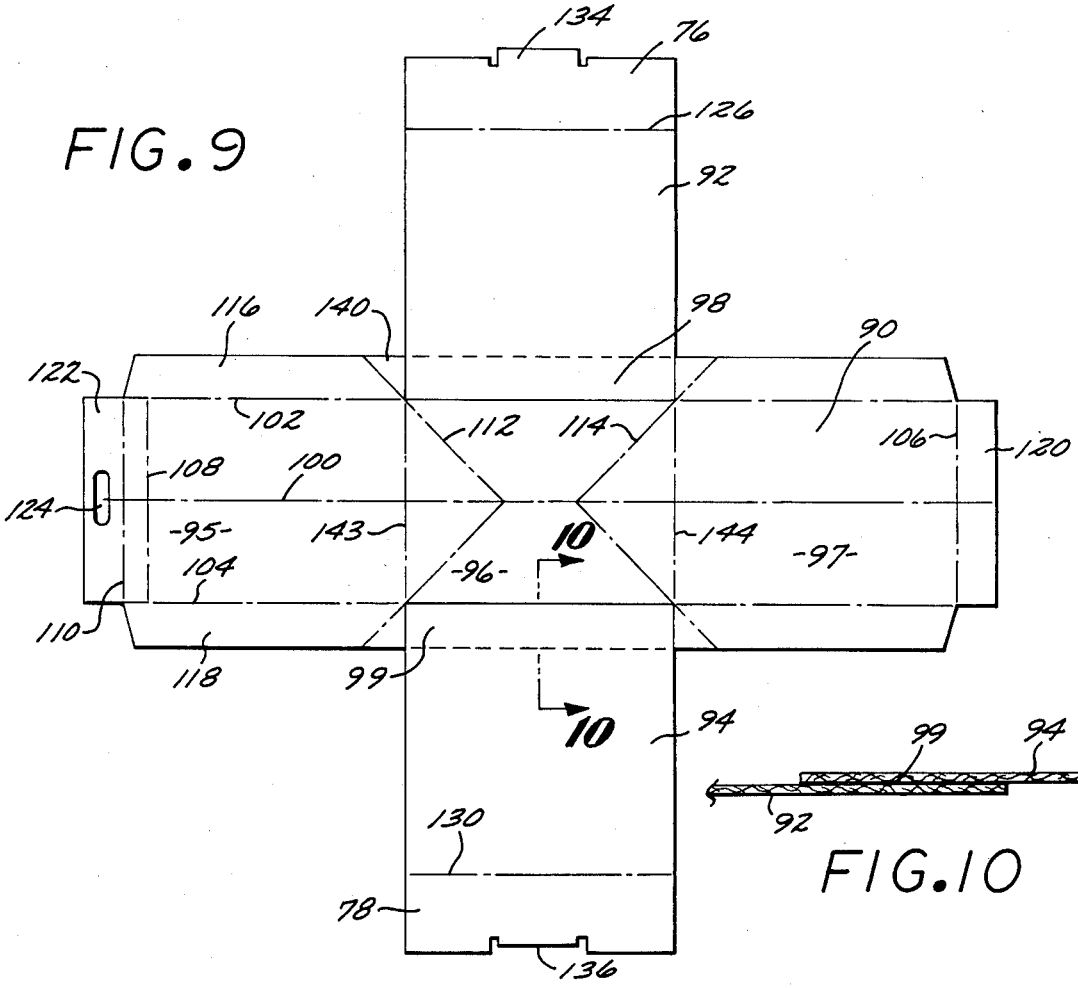
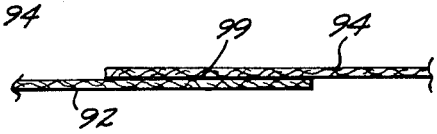
FIG. 10

AIRCRAFT TRASH COMPACTOR AND BOX THEREFOR

BACKGROUND OF THE INVENTION

Handling of the large amounts of waste material generated during the flight of passenger-carrying aircraft has long presented a major problem. Since the introduction of wide-bodied jet aircraft with their extended range and high passenger density configuration, this problem has grown even more serious, not only from an in-flight service point of view, but also with respect to flight safety. Current methods of waste disposal include the use of paperboard and synthetic plastic bags utilized with trash bins or trash carts requiring large storage areas. Excess trash containers are stored in the corner of galley compartments, in lavatories, thereby rendering them unusable for passengers, and even behind the last row of passenger seats or in unused passenger seats. More importantly, such filled trash containers present a serious danger of on-board fire. The filled trash containers are unsightly and interfere with passenger movement about the aircraft. The handling thereof, moreover, seriously increases the workload of in-flight and ground personnel.

SUMMARY OF THE INVENTION

It is a major object of the present invention to provide a trash compactor and a collapsible box for use therewith, particularly adapted for use on passenger-carrying aircraft to solve the waste material handling problems set forth hereinabove.

Another object of the present invention is to provide an aircraft trash compactor of the aforedescribed nature which is readily operable by in-flight personnel, requiring minimum attention to distract such personnel from their other duties.

A further object of the present invention is to provide an aircraft trash compactor of the aforedescribed nature which is simple in design and rugged of construction.

Yet a further object of the present invention is to provide a trash compactor of the aforedescribed nature which occupies a minimum amount of space while handling a maximum volume of trash.

A more particular object of the present invention is to provide an aircraft trash compactor of the aforedescribed nature that includes a housing formed with front and rear box chambers to receive first and second collapsible trash-receiving boxes, a front door for the housing having a trash-receiving chute in its upper portion, and a power-operated power head movable in the front box chamber to crush trash into the first box that is initially disposed in the front box chamber. When the first box is filled with crushed trash, the front door is opened and the first box is pushed to the rear box chamber. The second box is then positioned within the front box chamber to receive trash, and the front door is shut. The collapsible boxes have a front wall disposed at the same elevation as the lower edge of the chute, while the tops of the side and rear walls are at a higher elevation than the top of the front wall to permit the boxes to receive a maximum amount of trash for their size. The tops of the walls are provided with closure flaps. The bottom portion of the box is of liquid-tight construction.

An additional object of the present invention is to provide a collapsible box for use with the aforedescribed aircraft trash compactor.

These and other objects and advantages of the present invention will become apparent from the following detailed description, when taken in conjunction with the attached drawings.

BRIEF DESCRIPTION OF THE DRAWINGS

FIG. 8 shows the components of a collapsible box, particularly adapted for use with the trash compactor of the present invention.

FIG. 9 is a plan view showing how the parts of said box are connected together.

FIG. 10 is a vertical sectional view in enlarged scale taken along line 10—10 of FIG. 9.

DESCRIPTION OF THE PREFERRED EMBODIMENT

Figure 1:
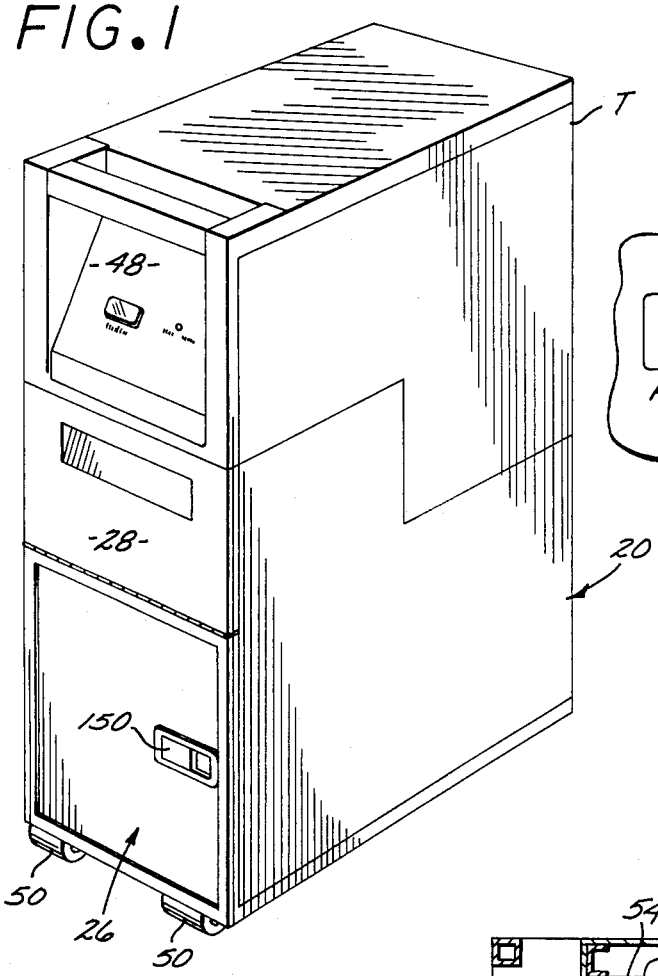
FIG. 1 is a front perspective view showing a preferred form of aircraft trach compactor embodying the present invention.
Figure 2:
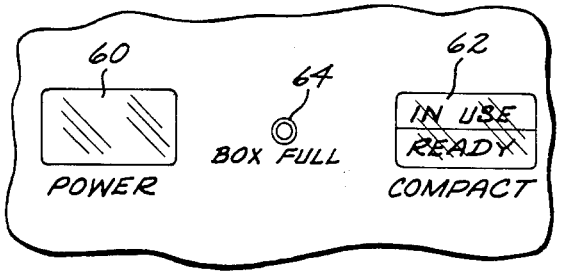
FIG. 2 is a fragmentary view taken in enlarged scale of the controls utilized with the trash compactor of FIG. 1.

Referring to the drawings, and particularly FIGS. 1 through 7 thereof, there is shown a preferred form of aircraft trash compactor T embodying the present invention. Compactor T includes a generally rectangular housing, generally designated 20, formed with front and rear box chambers 22 and 24, respectively, to receive first and second collapsible trash-receiving boxes B-1 and B-2. The housing 20 is provided with a front door, generally designated 26, hinged at one side so as to be manually swingable from its closed position shown in solid outline to its open position shown in phantom outline in FIGS. 3 and 4. Front door 26 is formed at its upper portion with a trash-receiving chute, generally designated 28. Chute 28 is hingedly connected along its lower edge to the front door 26 by hinges 32. The chute is swingable between its closed position shown in the drawings to its open position shown in phantom outline in FIG. 3. Mounted within housing 20 is a power-operated compacting head 34, which is vertically reciprocable relative to front box chamber 22. In the operation of the preferred form of trash compactor, the first box B-1 is initially disposed within front box chamber 22. Thereafter, trash is deposited within the confines of box B-1 through the trash-receiving chute 28. The power-operated compacting head 34 is serially urged downwardly within the confines of box B-1 so as to crush trash 38 deposited therewithin through chute 28. When box B-1 has been filled with crushed trash, the front door 26 is opened and the trash-filled first box B-1 is pushed rearwardly into the rear box chamber 24. Thereafter, second box B-2 is positioned within first box chamber 22 in a trash-receiving position.

More particularly, housing 20 is preferably of lightweight metallic construction and includes a rigid frame 40 having a bottom wall 42, a rear panel 44, side panels 45, an upper panel 46, and an inclined and recessed control panel 48. Castors 50 depend from the underside of the frame. Horizontal frame elements 52 are provided at the intermediate portion of the frame above the front and rear box chambers to receive a hydraulic ram assembly 54 which effects vertical reciprocation of the compacting head or platen 34. Hydraulic power is provided for the hydraulic ram unit by means of a conventional hydraulic pump 56 driven by an electric motor 58, both carried by frame elements 52. The operation of the hydraulic ram unit 54 is controlled by suitable switches and valves (not shown). The switches and valves are suitably connected to translucent push buttons 60 and 62 mounted on the control panel 48. When depressed, push button 60 connects the electrical components of the trash compactor to a suitable souce of electric power (not shown). When push button 60 is so depressed, it will be illuminated to indicate the power has been connected to the trash compactor. Push button 62, when depressed, causes the hydraulic ram unit 54 to effect reciprocation of the compacting head 34. Preferably, push button 62 will be provided with two indicator lights and the markings "IN USE" and "READY." The first indicator light will respond to movement of the compacting head so as to illuminate the marking "IN USE" in red during actuation of such compactor head. The lower portion of push botton 62 bearing the marking "READY" will be illuminated in green when the compacting head has been returned to its uppermost position shown in FIGS. 3 and 6. A signal light 64 bearing the marking "BOX FULL" will indicate when the boxes B-1 and B-2 have been filled with crushed trash. It should be understood that suitable safety interlock means (not shown) are interposed between the front doors 26, chute 28, and hyraulic ram unit 54 to prevent actuation of the hydraulic ram unit except when the front door and chute are disposed in their closed positions. Such interlock means, however, do not form part of the present invention.

Trash receiving chute 28 is provided with sides 70 and 72 that extend inwardly from the hollow front wall 74. Such sides 70 and 72 guide trash into the confines of the box B-1 or B-2 while such boxes are located in the front box chamber 22, and the chute is disposed in its open position indicated in phantom outline in FIG. 3. When the chute is disposed in its closed position, the sides 70 and 72 abut the inner surfaces of the side closure flaps 76 and 78 of the boxes so as to ensure that such closure flaps are maintained out of the path of reciprocation of the compacting head 34. The front wall 74 of the chute 28 is formed with an inwardly and upwardly extending finger-receiving recess 80 for easy manipulation of the chute between its open and closed position.

Referring now to FIGS. 8–15, there is shown a preferred form of collapsible paperboard box embodying the present invention and particularly designed for use with the aforedescribed trash compactor T, and corresponding to boxes B-1 and B-2 shown in the preceding drawing figures. The box includes a main panel 90, right side panel 92, and left side panel 94, which are formed independently of one another as indicated in FIG. 8. Main panel 90 defines the front 95, bottom 96, and rear 97 walls of the box. Referring to FIGS. 9 and 10, the side panels 92 and 94 are shown with their inner portions adhered to the midportion of main panel 90 along areas 98 and 99. FIG. 9 also discloses the fold lines which are impressed in a conventional manner on the paperboard panels so as to permit the panels to be collapsibly interfitted. Thus, main panel 90 is formed with a longitudinally extending centerfold 100 and longitudinally extending side fold lines 102 and 104 that coincide with the bottom edge of the side panels. The main panel 90 is also formed with a laterally extending rear fold line 106 and parallel front fold lines 108 and 110. The midportion of main panel 90 is formed with a pair of inwardly and longitudinally inclined fold lines 112 and 114 that cross fold lines 102 and 104. The fold lines 102 and 104 define front and rear seal flaps 116 and 118. Rear fold line 106 defines a rear closure flap 120. Front fold lines 108 and 110 define a front closure flap 122 having a finger opening 124. Side panel 92 is formed with a fold line 126 that defines left upper closure flap 76 shown in FIG. 4. Right side panel 94 is formed with a similar fold line 130 that defines a similar upper closure flap 78. It should be noted that side closure flap 76 is provided with a closing tongue 134 which complementarily interfits with a closure groove 136 formed on the other side panel 78 to hold the closure flaps 76 and 78 together with front and rear closure flaps 120 and 122 tucked therebelow.

Figure 11:
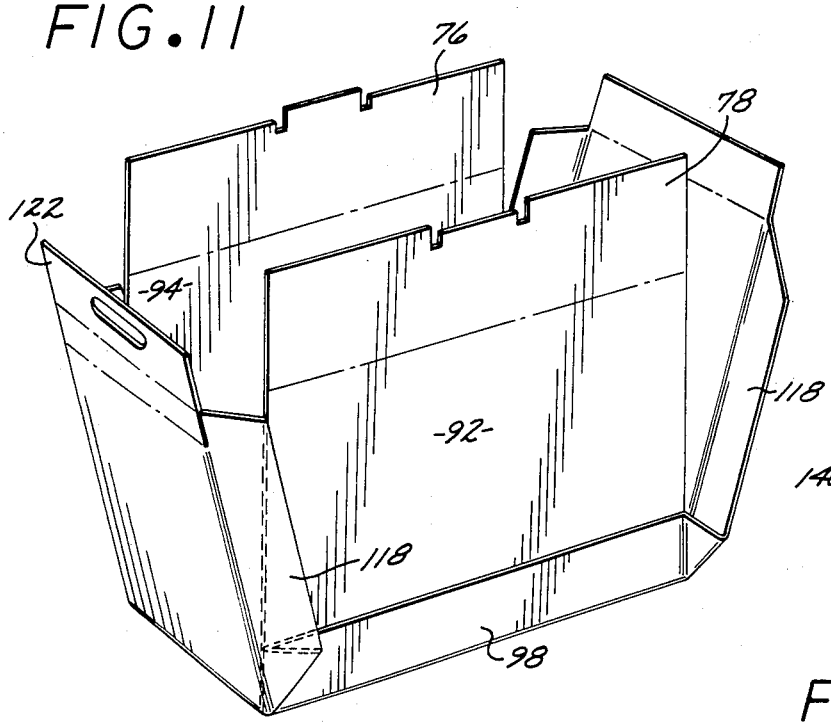
FIG. 11 is a perspective view showing the box being assembled.
Figure 14:
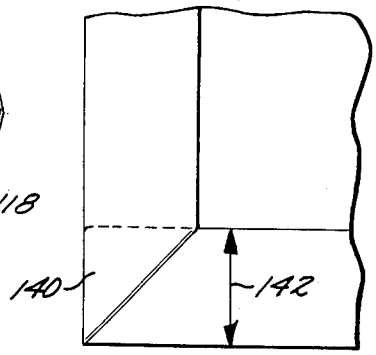
FIG. 14 is a fragmentary view of a water-tight bottom joint of the box.
Figure 12:
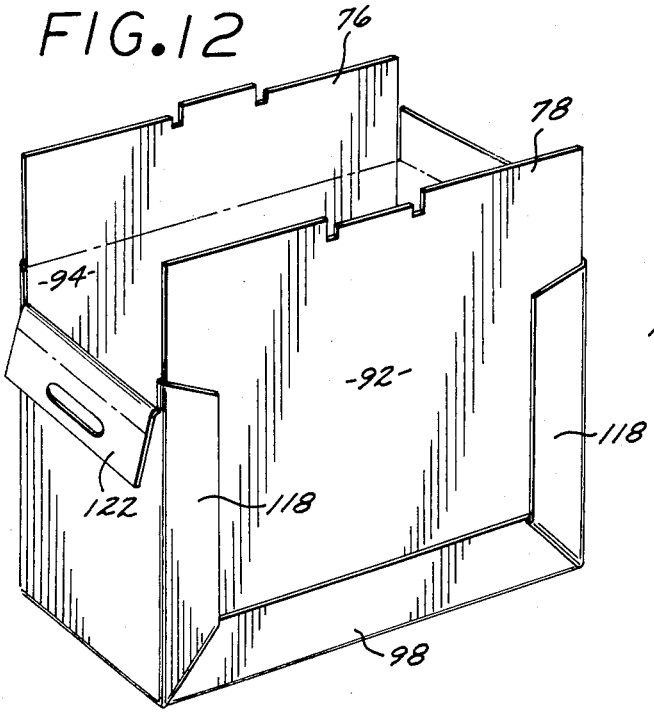
FIG. 12 is a perspective view of the box after it has been assembled.

Referring now to FIGS. 11 and 12, the panels 90, 92, and 94 are assembled into a box by folding such panels along the aforedescribed fold lines and adhering the interior of the seal flaps 96, 98, 116, and 118 to the exterior of the side panels 92 and 94. It should be particularly noted that the outer portions of the fold lines 112 and 114 define overlapping triangular areas 140 between folded together closure flaps 116 and 118 and the lower portion of the panels 92 and 94, as shown in FIG. 14 when the panel elements are interfitted and adhered in the manner shown in FIGS. 11 and 12. These areas 140 will serve to provide a liquid-tight bottom portion designated 142 in FIG. 14 for the assembled box. Fold lines 112 and 114 intersect base fold lines 143 and 144 which define the bottom sides of the box.

Figure 15:
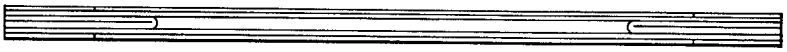
FIG. 15 is an end view of a box in a collapsed position.
Figure 13:
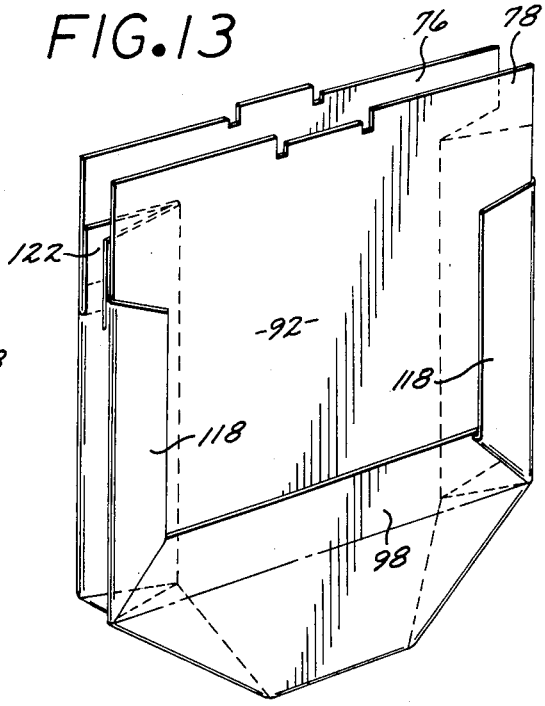
FIG. 13 is a perspective view showing the box of FIG. 12 in its collapsed position.

Referring now to FIGS. 13 and 15, when the box components have been assembled as indicated in FIG. 12, they will be collapsed for convenient storage, both on the ground and in the aircraft. This collapsing feature is provided by the arrangement of fold lines described hereinbefore. It should be particularly noted that in the collapsed position of the box, the rear closure flap 120, front closure flap 122, and side closure flaps 128 and 132 each extend upwardly. When the box is ready to be inserted within the trash compactor T, it will be expanded to its position of FIG. 12. At this time, the rear closure flap 120 and the side top closure flaps 128 and 132 will remain in an upwardly extending position. The configuration of the intersecting fold lines 100, 112, and 114 tend to retain the box in its expanded condition.

Figure 3:
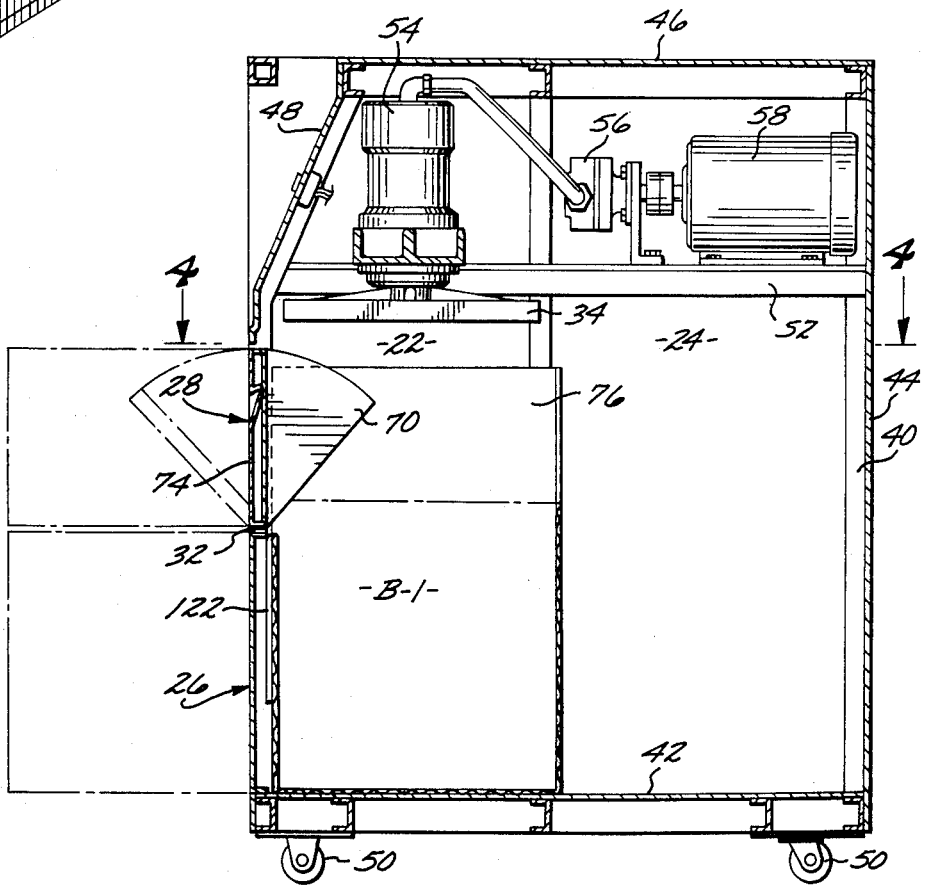
FIG. 3 is a central vertical sectional view of the trash compactor of FIG. 1.
Figure 4:
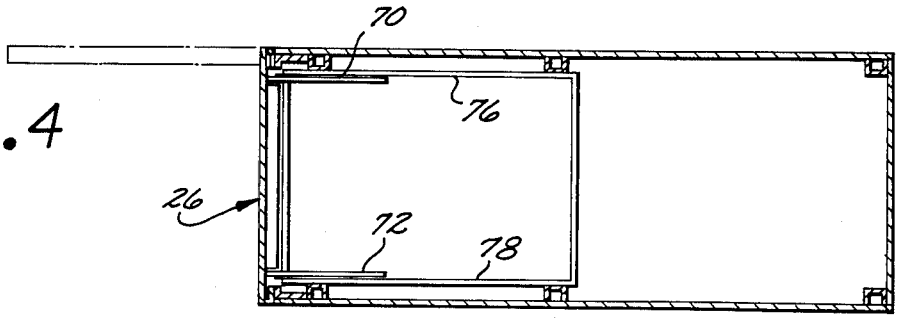
FIG. 4 is a horizontal sectional view taken along lines 4—4 of FIG. 3.
Figure 5:
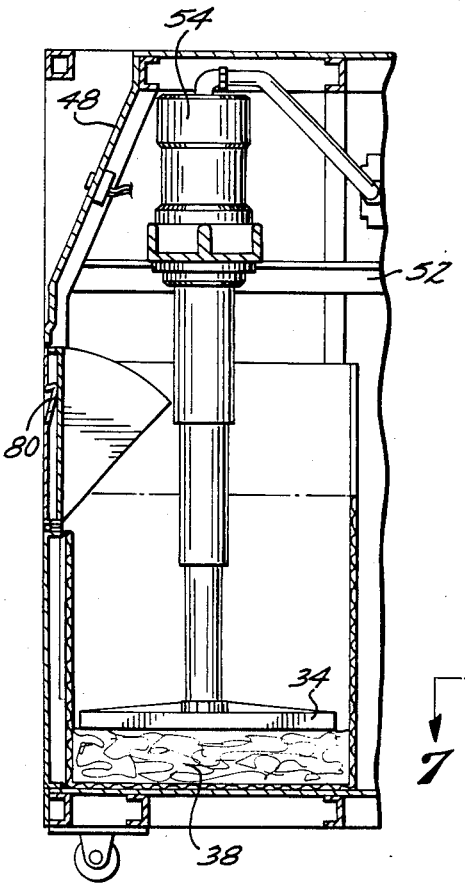
FIG. 5 is a fragmentary vertical sectional view showing the front box chamber of the trash compactor during a trash compacting operation.
Figure 6:
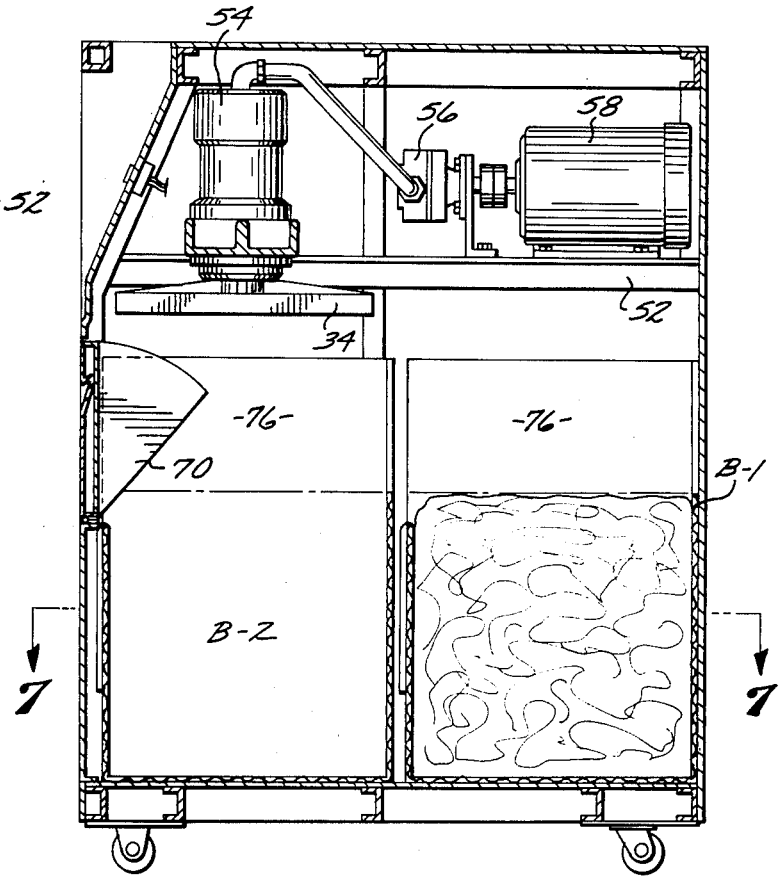
FIG. 6 is a vertical sectional view similar to FIG. 3, but showing a trash-filled box disposed in the rear box chamber of the trash compactor and a second box disposed in position to receive trash.
Figure 7:
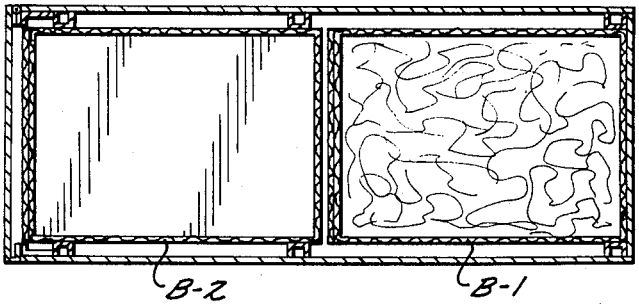
FIG. 7 is a horizontal sectional view taken on line 7—7 of FIG. 6.

With the box expanded, front closure flap 122 is bent downwardly as indicated in FIG. 12. To position box B-1 within front box chamber 22 front door latch 150 is disengaged and the front door is swung into its open position. Box B-1 is then inserted into its position in front box chamber 22 as shown in FIG. 3. The front door 26 is then latched in its closed position and the box is ready to receive trash. After box B-1 has been filled with crushed trash 38, the indicator light 64 will be illuminated. An aircraft flight crew person then need only swing the front door 26 open and push the trash-filled box B-1 to the rear box chamber 24 and replace such trash-filled box with an empty second box B-2. When the front door 26 is again returned to its closed position, the box B-2 will be ready to receive trash for compaction by the compacting head 34. It should be particularly noted that the trash dumped into the boxes B-1 and B-2 will include liquid-containing cups and other containers. The provision of the water-tight bottom portion of the boxes will effectively contain such liquid within the boxes until they have been removed from the aircraft.

It will be understood that various modifications and changes may be made with respect to the foregoing detailed description without departing from the spirit of the present invention.

We claim:

1. A trash compactor for use with a trash-receiving box including a body having side and back walls of predetermined height, a front wall of a selected height less than said predetermined height, said box further having a predetermined exterior horizontal cross section, a selected interior cross section and having closure flaps of a predetermined thickness, said back and side flaps being arranged to originally extend upwardly from the top of the rear and side box walls to terminate in top edges spaced a selected distance from the bottom of said box, said trash compactor comprising:

a housing having a box chamber that receives such box with the front closure flap of the box bent downwardly and the rear and side closure flaps of the box extending upwardly;

a power-operated compacting head including a vertically reciprocable platen movable downwardly into said box when the latter is disposed in the box chamber and configured to space the opposite sides thereof away from said side walls of said housing a distance greater than said predetermined thickness to thereby form respective side clearance spaces;

a normally closed front door extending upwardly from said housing bottom wall a distance greater than said selected distance;

a normally closed trash-receiving chute formed in the upper portion of said front door and extending upwardly from said predetermined height, said chute being movable from a closed to an open position for dumping trash into said box disposed in said box chamber; and with said trash-receiving chute being formed with a front wall and side retainers that extend inwardly from said front wall, said chute being movable between its open position, wherein said retainers and front wall guide trash into the front box chamber, and its closed position wherein said retainers project rearwardly into said respective clearance spaces and along the inner surfaces of said side closure flaps to maintain said flaps out of the path of said compacting platen when the latter is disposed within said box.

2. A trash compactor as set forth in claim 1 wherein said housing has front and rear box chambers, with the front door being opened to permit a first trash-filled box in the first box chamber to be mannually pushed into the rear box chamber, and a second box to be positioned within the front box chamber.

3. A trash compactor as set forth in claim 1 wherein said front door is hinged at one side to said housing for horizontal swinging movement between its open and closed positions.

4. A trash compactor as set forth in claim 1 wherein in the trash-receiving chute is hingedly connected along its lower edge to the front door for swingable movement between its open and closed positions.

5. A trash compactor as set forth in claim 3 wherein the trash-receiving chute is hingedly connected along its lower edge to the front door for swingable movement between its open and closed positions.

* * * * *